US006341500B1

(12) United States Patent
Paxman

(10) Patent No.: US 6,341,500 B1
(45) Date of Patent: Jan. 29, 2002

(54) BEVERAGE COOLING SYSTEM

(75) Inventor: Neil Eric Paxman, Huddersfield (GB)

(73) Assignees: Coolflow LTD, Huddersfield; Interbrew UK Ltd., Bedfordshire, both of (GB)

( * ) Notice: Subject to any disclaimer, the term of this patent is extended or adjusted under 35 U.S.C. 154(b) by 0 days.

(21) Appl. No.: 09/661,205

(22) Filed: Sep. 14, 2000

(30) Foreign Application Priority Data

Sep. 14, 1999 (GB) ..... 9921698

(51) Int. Cl.[7] ..... B67D 3/62
(52) U.S. Cl. ..... 62/389; 62/396; 62/98
(58) Field of Search ..... 62/389, 396, 393, 62/98; 222/1, 146.6

(56) References Cited

U.S. PATENT DOCUMENTS 2,677,255 A * 5/1954 Wright ..... 62/141
2,771,752 A * 11/1956 Tennant ..... 62/141
4,881,380 A * 11/1989 Mrugala et al. ..... 62/389
5,094,088 A * 3/1992 Davis ..... 62/393

FOREIGN PATENT DOCUMENTS

GB 2-146620 A * 9/1983

* cited by examiner

*Primary Examiner*—Henry Bennett
*Assistant Examiner*—Melvin Jones
(74) *Attorney, Agent, or Firm*—Sughrue Mion, PLLC

(57) ABSTRACT

A beverage line (1) and a water line (2) exit from a Python cooling system (3) and enter a manifold (4). The beverage line (1) runs directly through the H-shaped manifold (4) to a tap (5). The water line (2) enters the manifold (4) and water flows through and exits through pipe (6) which surrounds the beverage pipe (1). Adjacent the tap (5), the water flows out of the coaxial pipe (6) and down return pipe (7) which connects into the manifold (4) at connection point (8). The water flows out of the manifold (4) through pipe (9). A bypass pipe (10) is provided in the manifold (4). This allows narrower gauge pipes to be used in the cooling loop without throttling the is flow of water through the Python. A valve (11) is provided in the bypass pipe (10) allowing the flow through the bypass pipe (10) to be reduced or shut off, so that all the flow through inlet pipe (2) is directed through the cooling loop, to remove airlocks.

6 Claims, 1 Drawing Sheet

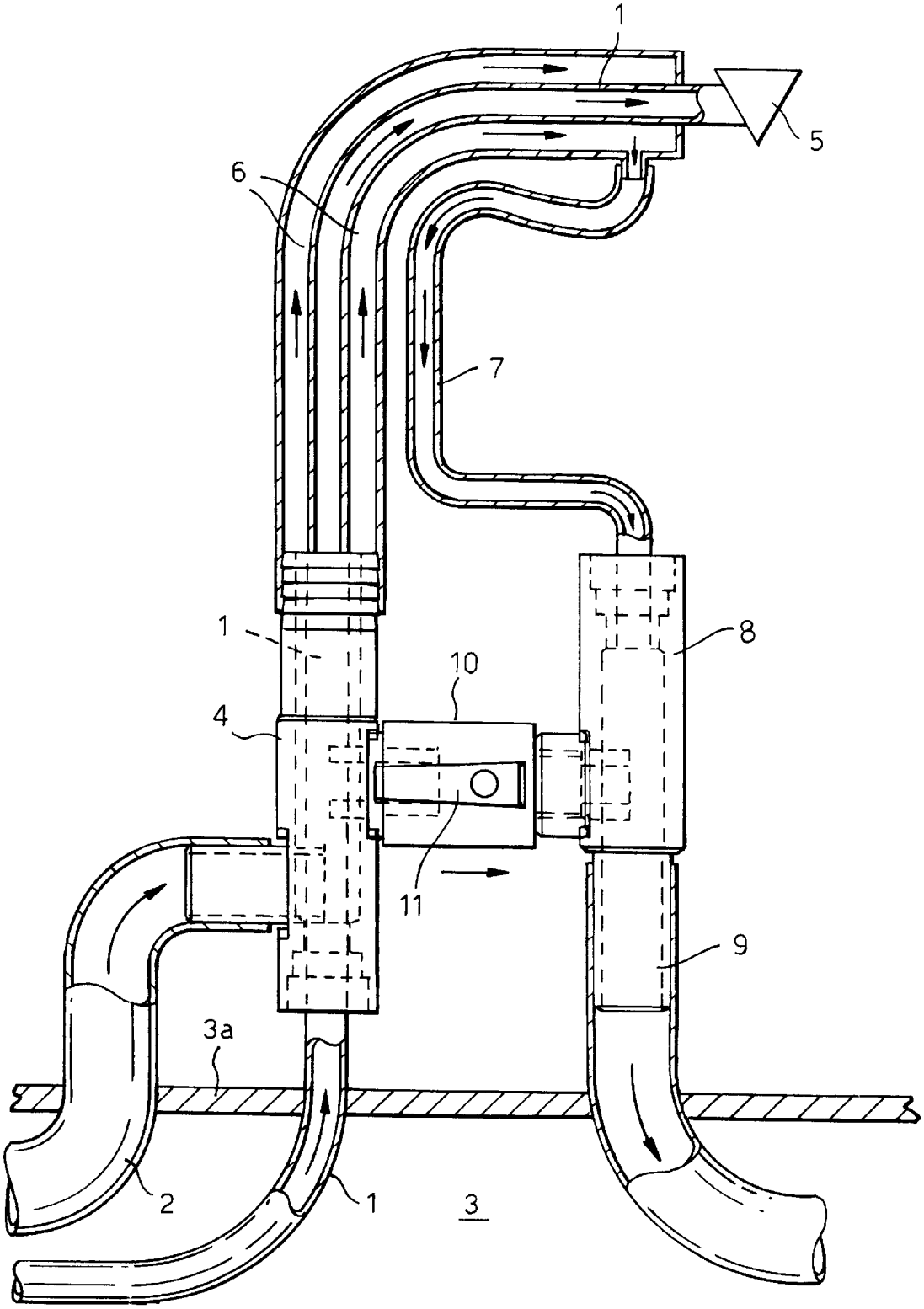
1
5
6
7
1
8
10
4
11
9
3a
2
1
3

BEVERAGE COOLING SYSTEM

In pubs, bars and restaurants, carbonated beverages such as beer and soft drinks are generally dispensed from a cask or keg through a pipe to a dispense tap at the point of delivery. It is desirable for the beverage to be dispensed at a cool temperature. In the case of a highly carbonated beverage such as lager, it is particularly important that the beverage is cool because this prevents fobbing of the beverage when it is dispensed and efficient cooling of the beverage can therefore significantly reduce the time taken to dispense a measure of beverage.

conventionally therefore, the keg itself is cooled, for example by providing this in a cold environment such as a refrigerated cellar, so that the beverage delivered to the dispense tap is cool. Additionally or alternatively, an in-line cooler is provided to cool the beverage as it is supplied to the tap.

Where the keg is cooled, the beverage being dispensed through the tap must pass through a pipe between the keg and the dispense tap. As the pipe normally passes through a warm environment, the beverage will warm after leaving the keg. Especially where the dispense point is a long distance from the keg, or where the rate at which the beverage is dispensed is low, the beverage will remain in the pipe for a long period and therefore will be much warmer than the beverage in the keg. Therefore the beverage will not be at the desired temperature as it is dispensed and fobbing will occur on dispensing the beverage. Furthermore, the temperature of most cellars is controlled to the storage temperature for cask beverages. This temperature is greater than that at which it is desirable to dispense beverages from kegs, in particular lagers which are highly carbonated and more inclined to fobbing when dispensed if they are not sufficiently cooled.

Where a cooler is provided to cool the beverage as it is supplied to the dispense tap, to avoid the problem of cooled beverage warming as it remains in the pipe between the cooler and the dispense tap, the cooler is conventionally provided close to the dispense tap, and therefore takes up a lot of room near the bar and radiates heat into the bar area.

An alternative in-line system is the "Python" system. In this system, the beverage is first passed through an in-line cooler such as an ice bath, and cold water is recirculated through a loop of pipe leading from the ice bath to the dispense point, the water being cooled at some point along the recirculating path. The beverage dispense pipes surround the loop of pipe carrying the cold water and the bundle of beverage pipes and water pipes is surrounded by an insulating jacket. Therefore the beverage is cooled by the cold water as the beverage is passed to the dispense point. Typically 8 to 12 beverage pipes surround two water pipes, one carrying the outward flow of water and the other carrying the return flow.

However, the Python system requires each beverage pipe to emerge from the Python bundle at some point to connect to a rap on the bar, and in the distance between the Python and the tap (typically about 2 meters) the beverage warms up, particularly if the beverage is not dispensed at a high rare and the beverage remains in the pipe for long periods of time. This causes considerable fobbing of the beverage on dispensing, which both increases the dispense time and causes wastage of beverage.

It has been suggested that to cool the beverage pipe between the Python and the tap, the flow of water through one of the Python lines could be directed through a coaxial pipe such that the cool water flows up the outer pipe surrounding the central pipe carrying the beverage. At the cap, the water would exit the coaxial pipe and flow back down to rejoin the Python. The coaxial pipe from the Python to the tap must have a diameter large enough to accommodate the beverage pipe, which typically has a ⅜ inch diameter, plus the flow of water from the Python. The water pipe from the Python typically has a 15 mm diameter.

Many counter mounts do not have space to accommodate both a coaxial pipe of this size and the return water pipe which must be of the same size as the water pipe from the Python to accommodate the water flow. Reducing the cross sectional area of the coaxial pipe and accordingly reducing the diameter of the return water pipe will have the effect of throttling the flow of the Python and reducing its cooling effect. Replacing the counter mount with one having more space to accommodate larger pipes would be expensive and undesirable, as the particular shape and design of the counter mount is often distinctive to the brand of beverage.

According to the present invention, a cooled beverage supply system comprises:

- a coaxial pipe having a central pipe for connection to a supply of beverage at a first end and for connection to a dispensing cap at a second end and an outer pipe for connection to a supply of cooled water at a first end and for connection to a return pipe at a second end adjacent the dispensing tap; and
- a bypass pipe connecting the outer pipe to the return pipe and including a valve which may be opened to allow flow through the bypass pipe or closed to prevent flow through the bypass pipe.

The supply of cooled water and the supply of beverage are preferably from a beverage cooling system having at least one pipe carrying water and at least one pipe carrying beverage.

The central pipe of the coaxial pipe is typically connected to one of the beverage lines from the Python and the outer pipe is connected to one of the water lines. The cool water circulates up the outer pipe, keeping the beverage cool until it reaches the tap and returns to the Python via the return pipe. The bypass pipe is provided such that the size of the coaxial pipe and the return pipe may be reduced so that they fit inside any counter mount without throttling the flow of the Python. The combined capacity of the outer pipe and the bypass pipe should be at least equal to the capacity of the water line from the Python, and the flow of water from the Python is split between the bypass pipe and the flow to the tap through the outer pipe. The return pipe has the same flow capacity as the outer pipe.

However, the present inventors have found that when a bypass pipe is provided, when the system is started up the pressure of water is not sufficient to expel air from the water pipes to and from the tap. The narrower the water pipes to and from the dispense tap are, the more difficult it becomes to expel the air from the pipes, and an air lock is produced. Therefore, a valve is provided in the bypass pipe which is closed when the system is started up, so that the flow of water from the Python may only pass up the outer pipe of the coaxial pipe, providing sufficient pressure to expel air from the system. Once flow has started the valve may be opened and flow will continue by virtue of a syphon effect. At any point when an airlock occurs, this can be removed by closing the valve for a short period of time.

The present inventors have found that the use of the cooling system can reduce the dispense time for a pint of beverage from approximately 15–20 seconds, to 9 seconds because the fobbing of the beverage is considerably reduced.

The valve in the bypass pipe may be operated by a handle, but preferably it is operated by turning an implement such as a screwdriver or a coin in a slot. This prevents the valve from being closed accidentally when the system is operating. Preferably the valve is a ball valve.

Preferably, the beverage supply system includes a manifold having a first inlet for receiving a pipe containing beverage; a second inlet for connecting a pipe containing cooled water to a first chamber surrounding the beverage pipe; a first outlet for allowing the beverage pipe to exit the manifold coaxially with a surrounding water pipe which is in connection with the first chamber; a third inlet for connecting the return pipe to a second chamber; a second outlet in connection with the second chamber for connecting a pipe to allow water to exit the second chamber; a bypass pipe connecting the first and second chambers and having a valve which may be closed to prevent flow of water from the first chamber to the second chamber.

An example of the present invention will be described with reference to the accompanying drawing which shows a schematic view of a beverage supply system.

In the drawing, a beverage line 1 and a water line 2 exit from the insulation 3*a* of a Python 3 comprising a bundle of beverage and water lines. The water line 2 and the beverage line 1 enter a manifold 4. The water line 2 may be either the outward or the return water line from the Python. The beverage line 1 runs directly through the H-shaped manifold 4 to a tap 5 where beverage (for example beer) is dispensed. The water line 2 (which carries cooled water) enters the side of the manifold 4 and water flows through the manifold 4 and exits through pipe 6 which surrounds the beverage pipe 1. The water within pipe 6 keeps the beverage in the beverage line 1, between the Python and the tap, cool. The vertical distance between the Python and the tap is usually approximately 2 meters. At or substantially adjacent to the tap 5, the water flows out of the coaxial pipe 6 and down return pipe 7. The return pipe 7 connects into the manifold 4 at connection point 8. The water flows out of the manifold 4 through pipe 9 which rejoins the Python 3.

A bypass pipe 10 is provided in the manifold 4 so that some of the cooling water from the Python 3 which enters through inlet pipe 2 may bypass the cooling loop, which consists of the outer pipe 6 and the return pipe 7, and flow directly to join the flow from the return pipe 7 back through outlet pipe 9 and back into the Python. This allows narrower gauge pipes to be used to carry the water around the cooling loop without throttling the flow of cooling water through the Python.

A ball valve 11 is provided in the bypass pipe 10 allowing the flow through the bypass pipe 10 to be reduced or shut off. The valve 11 may be operated by a handle or, to prevent the valve being accidentally closed, by a slot which may be turned with a screwdriver. Alternatively, the operation of the valve may be automated. The valve 11 is closed when the system is started, so that all the flow through inlet pipe 2 is directed through the cooling loop, providing sufficient pressure to expel trapped air from the cooling loop. Once flow has started, the valve 11 may be opened so that the flow in the Python is not throttled.

To prevent throttling of the flow of the Python, the combined capacity of the bypass pipe 10 and the outer pipe 6 should be at least equal to the capacity of the Python line 2. The coaxial pipe consisting of the outer pipe 6 and the beverage pipe 1, together with the return pipe 7, must fit inside a counter mount which is located on a bar. For counter mounts with very little space, the size of the outer pipe 6 and the return pipe 7 may be reduced, provided that the size of the bypass pipe 10 is increased accordingly, thus altering the proportion of the flow of water from the Python which passes through the cooling loop.

An olive on the beverage pipe 1 is used as a seal at the end of the outer pipe 6 adjacent the tap. A similar arrangement may be used to seal the pipes entering or exiting the manifold 4.

Rather than forming the manifold 4 as an H-shaped component as shown in the drawing, it may be formed from a block in moulded plastic having John Gest push in fittings for connecting the pipes. The conduits inside the block would form the same H-shape as shown in the drawing.

Accordingly, at least in the preferred embodiment of the present invention, a simple but effective beverage cooling system is provided which may be retrofitted to existing beverage dispensing systems, even where space is minimal.

What is claimed is:

1. A cooled beverage supply system comprising:

a coaxial pipe having a central pipe (1) for connection to a supply of beverage at a first end and for connection to a dispensing cap (5) at a second end and an outer pipe (6) for connection to a supply of cooled water au a first end and for connection to a return pipe (7) at a second end adjacent the dispensing cap (5); and a bypass pipe (10) connecting the outer pipe (6) to the return pipe (7) and including a valve (11) which may be opened to allow flow through the bypass pipe (10) or closed to prevent flow through the bypass pipe (10).

2. A cooled beverage supply system according to claim lo wherein the supply of cooled water and the supply of beverage are from a beverage cooling system (3) having at least one pipe carrying water and at least one pipe carrying beverage.

3. A cooled beverage supply system according to claim 1 wherein the valve (11) in the bypass pipe (10) is operated by a handle.

4. A cooled beverage supply system according to claim 1 wherein the valve (11) is operated by turning an implement in a slot.

5. A cooled beverage supply system according to claim 1 wherein the valve (11) is a ball valve.

6. A cooled beverage supply system including a manifold (4) having a first inlet for receiving a pipe (1) containing beverage; a second inlet for connecting a pipe (2) containing cooled water to a first chamber surrounding the beverage pipe (1); a first outlet for allowing the beverage pipe (1) to exit the manifold (4) coaxially with a surrounding water pipe (6) which is in connection with the first chamber; a third inlet (8) for connecting a return pipe (7) to a second chamber; a second outlet (9) in connection with the second chamber for connecting a pipe to allow water to exit the second chamber; a bypass pipe (10) connecting the first and second chambers and having a valve (11) which may be closed to prevent flow of water from the first chamber to the second chamber.

* * * * *